United States Patent [19]

Pahlman et al.

[11] 4,306,905

[45] Dec. 22, 1981

[54] PRODUCTION OF FERROCHROMIUM ALLOYS

[75] Inventors: John E. Pahlman, Bloomington; Sanaa E. Khalafalla, Minneapolis, both of Minn.

[73] Assignee: The United States of America as represented by the Secretary of the Interior, Washington, D.C.

[21] Appl. No.: 197,864

[22] Filed: Oct. 17, 1980

[51] Int. Cl.[3] ..... C22C 33/00

[52] U.S. Cl. ..... 75/130.5; 75/133.5; 75/176

[58] Field of Search ..... 75/176, 130.5, 133, 75/133.5

[56] References Cited

U.S. PATENT DOCUMENTS 1,346,187 7/1920 Fahrenwald ..... 75/130.5
2,763,918 9/1956 Megill ..... 75/176

FOREIGN PATENT DOCUMENTS 720065 10/1965 Canada ..... 75/133.5

*Primary Examiner*—L. Dewayne Rutledge
*Assistant Examiner*—David A. Hey
*Attorney, Agent, or Firm*—William S. Brown; Donald A. Gardiner

[57] ABSTRACT

Ferrochromium alloys are prepared by vacuum reduction of chromite concentrate by means of a carbonaceous reductant, followed by melting in the presence of slag-forming materials to produce the alloy and a separate slag phase. Preferably, CaO is employed as an ingredient in both the reduction step and the melting step.

9 Claims, No Drawings

PRODUCTION OF FERROCHROMIUM ALLOYS

Because of the strategic importance of chromite ore, conservation of chromium in processing of the ore for production of stainless steels is very important. Reduction of capital and energy requirements of chromite processing are also important. It is, therefore, an object of this invention to reduce capital and energy requirements, and to conserve chromium, in production of ferrochromium alloys.

The prevalent method for processing chromite for use in the stainless steel industry involves submerged arc smelting of chromite with carbonaceous reductants to produce high-carbon ferrochrome (HCFeCr) with 4 to 10 percent C. This is an energy intensive process. To produce low-carbon stainless steels, an iron charge together with HCFeCr, and sometimes charge chrome or blocking chrome, are processed in the Argon-Oxygen-Decarburizer (AOD). Chromium recovery in the production of HCFeCr ranges from 85 to 90 percent while in the AOD it is greater than 98 percent. Refractory consumption is high in the AOD with a typical lining lasting around 100 hours or for 50 to 60 heats. The high refractory cost is a major disadvantage of the AOD. In addition, decarburization of the melt in the AOD requires use of expensive ferrosilicon to reduce chromium oxidized in the AOD and also large quantities of argon.

It has now been found, according to the process of the invention, that the above objective is achieved to a large extent by means of a process comprising vacuum reduction of chromite ore with a carbonaceous reductant and, subsequently, simple melting in the presence of suitable slag-forming materials to form the desired ferrochromium alloys. Production of medium-carbon or low-carbon ferrochromium alloys by this method obviates submerged arc smelting and improves chromium recovery to better than 98 percent. It has also been found that the process is further improved by the use of lime, i.e., CaO, as an additive in the reduction step, as more fully described below.

The feed material in the process of the invention is a chromite ore. Such ores consist essentially of $FeCr_2O_4$, sometimes with magnesium and aluminum present. In addition, the proportions of iron and chromium will vary somewhat. The process of the invention is, however, applicable to any chromite ore irrespective of its iron, chromium, magnesium, or aluminum content.

The ore is initially ground to a particle size, e.g., about 20 to 48 mesh, suitable for formation of a chromite concentrate from the ore. This is done by tabling or other conventional beneficiation processes for separation of gangue, usually consisting predominantly of silica, and comprising about 4 to 25 percent of the raw ore. The chromite concentrate is then comminuted, as by grinding, to a fine particle size, preferably about 325 to 400 mesh suitable for reduction.

The reductant consists of carbanaceous materials such as graphite, coal, carbon black, foundry coke, etc. This material is also comminuted to a size suitable for reaction with the chromite concentrate, e.g., about 325 to 400 mesh, and is then blended with the fine-ground chromite concentrate. Optimum proportions of the reductant will depend on the specific feed material, i.e., the specific chromite ore, on the specific reductant, on whether a medium-carbon or low-carbon ferrochromium alloy is desired as product, etc. Accordingly, optimum proportions are best determined experimentally. However, when graphite is employed as reductant, a suitable amount will generally range from about 10 to 20 percent of the weight of the chromite concentrate. For production of low-carbon ferrochromium alloys, stoichiometric amounts of reductant, preferably graphitic carbon, are needed for reduction of the chromium and iron contents of the concentrate.

Since the reduction step of the process of the invention is carried out in a vacuum, it is necessary to initially pelletize the chromite concentrate-reductant admixture. It has been found that this is most effectively accomplished, without introduction of contaminants, by the use of chromic acid, i.e., $CrO_3$, as a binder. This material is also employed in finely divided form, e.g., about 325 to 400 mesh, and is also blended with the chromite concentrate and the reductant.

In addition, as mentioned above, it has also been found that addition of calcium oxide prior to the vacuum reduction serves to accelerate the reduction and thereby substantially decrease the furnacing time required for the reduction. The CaO is also employed in finely divided form, again about 325 to 400 mesh, and is blended with the chromite concentrate, the reductant, and the chromic acid binder.

The admixture is then pelletized by conventional means, such as a pellet-making drum or extrusion, to form porous pellets, usually of a size of about 3 to 20 mesh. Reduction of the chromite is then effected by heating the pellets in a vacuum furnace at a temperature of about 1300° to 1350° C. and a pressure of about 0.4 to 10 torr for a time sufficient to obtain the desired extent of reduction. Time required may vary widely depending on specific reactants, reaction conditions, and desired extent of reduction. For example, a period of about 4 to 8 hrs. is usually sufficient for production of low carbon ferrochrome with CaO addition. Without CaO addition, a period of about 13 to 24 hrs. is usually required for production of low carbon ferrochrome. Temperature and pressure in the furnace are controlled to permit the maximum rate of reduction with minimum chromium vaporization.

The reduced product is then mixed with suitable slag composition-adjusting additives and melted to produce ferrochromium alloys and slag phases. The slag composition-adjusting additives are blended with the reduced product to lower the fusion temperature of the gangue material and allow rapid and complete segregation of the ferrochromium alloy and gangue materials (in the slag) at the lowest possible temperature. Suitable slag compositions may vary considerably again depending on the above mentioned variables. However, it has been found that optimum slag compositions will generally consist of about 28 to 30 percent each of CaO, MgO and $SiO_2$, and about 10 to 16 percent of $Al_2O_3$. Depending on the content of CaO, MgO, $SiO_2$, and $Al_2O_3$ in the chromite concentrate, varying amounts of these materials may have to be added to, and blended with, the reduced product to obtain the desired slag composition. In addition, the amount of CaO added will depend on the amount of this material, if any, that is added prior to the reduction step since the amount of CaO present is not substantially altered by the reduction step.

It has also been found that a saving in thermal energy may be achived by introduction of the slag composition-adjusting additives to the reduced product while still hot, e.g., about 1300° to 1350° C., after relieving the vacuum and backfilling with an inert gas such as argon.

Suitable temperature and time of melting of the reduced product will depend on the composition of the gangue material and the type and amount of additives mixed with the reduced products prior to melting. However, a temperature of about 1550° to 1700° C. and time of about 20 to 30 minutes is generally sufficient to achieve complete melting of the mixture and effective separation of alloy and slag phases.

Physical separation of the alloy and slag phases is readily achieved by conventional means such as pouring of the segregated liquid phases.

The invention will be more specifically illustrated by the following examples.

EXAMPLE 1

Two sets of reduction tests were made on 1.2 mm extruded pellets of minus 400 mesh graphite and minus 400 mesh chromite concentrate. Both sets of tests were conducted at 1300° C. under 1 torr pressure. In one set of tests, CaO was blended with the chromitegraphite mixture at a rate of 13 grams per 100 grams of chromite. In the other set of tests no CaO was added. In order to keep the amount of chromite in the pellets nearly constant for both tests, 28.7 gram samples of CaO-chromite-graphite pellets and 25.0 gram samples of chromite-graphite pellets were tested.

Table 1 shows the average results of 20 tests with CaO addition and 10 tests without CaO addition. These results indicate that the presence of CaO during the reduction of chromite accelerates the reduction and reduces the furnacing time by more than 50 percent.

TABLE 1

| Time, Hours | Percent reduction to Fe and Cr | |
|---|---|---|
| | 13 pct lime added | No Lime |
| 1 | 63 | 40 |
| 2 | 86 | 59 |
| 3 | 92 | 72 |
| 4 | 95 | 79 |
| 5 | 97 | 83 |
| 6 | 99 | 86 |
| 7 | 100 | 88 |
| 8 | 100 | 90 |
| 9 | 100 | 92 |
| 10 | 100 | 94 |
| 11 | 100 | 95 |
| 12 | 100 | 96 |
| 13 | 100 | 97 |
| 14 | 100 | 98 |
| 15 | 100 | 99 |
| 16 | 100 | 100 |

EXAMPLE 2

Twenty 25-gram samples of minus 10 plus 20 mesh extruded pellets of minus 400 mesh graphite and chromite concentrate were heated to 1300° C. under 1 torr pressure. The reduction was allowed to proceed to near completion in each case. The reduced products from these tests were blended and split into 80 gram samples. One of these 80-gram samples was blended with 14.0 grams of CaO (mixture 1) and a second 80-gram sample was blended with 14.0 grams of CaO and 12.9 grams of $SiO_2$ (mixture 2). Both blended mixtures were heated to 1700° C. and kept at temperature for 20 minutes to effect substantially complete melting of the components. The calculated compositions of the reduced product-additive mixtures are given in table 2.

TABLE 2

| Constituent | Additives Calculated content, percent | |
|---|---|---|
| | Mixture 1 14.0 g CaO | Mixture 2 14.0 g CaO 12.9 g $SiO_2$ |
| Cr | 45.0 | 39.6 |
| Fe | 10.4 | 9.1 |
| MgO | 17.0 | 14.9 |
| CaO | 16.2 | 14.2 |
| $Al_2O_3$ | 8.0 | 7.0 |
| $SiO_2$ | 2.9 | 14.7 |
| Weight mixture | 94.0 grams | 106.9 grams |

The calculated slag composition for mixture 2 was 28 percent CaO, 28.9 percent $SiO_2$, 29.3 percent MgO and 13.8 percent $Al_2O_3$, within the optimum slag composition range. Segregation of metallic (ferrochromium alloys) and slag phases, following melting, was fast and complete. Addition of CaO alone (mixture 1), however, resulted in sluggish and incomplete separation of metallic and slag phases following melting.

We claim:

1. A process for production of ferrochromium alloys from chromite concentrate comprising:
   (a) admixing and blending the concentrate, in finely divided form, with a finely divided carbonaceous reductant and a finely divided binder consisting essentially of chromic acid,
   (b) pelletizing the blended mixture to form porous pellets suitable for reaction in a vacuum furnace,
   (c) heating the pellets in said furnace at elevated temperature and reduced pressure for a time sufficient to effect reduction of the chromite with minimum vaporization of chromium,
   (d) admixing the reduced product from step (c) with slag composition-adjusting additives in amounts sufficient to lower the fusion temperature of gangue material in the reduced product, and
   (e) heating the admixture from step (d) at a temperature and for a time sufficient to melt the components thereof and form separate ferrochromium alloys and slag phases.

2. The process of claim 1 in which the reductant is graphite, coal, carbon black, or coke.

3. The process of claim 1 in which the pellets are heated, in step (c), at a temperature of about 1300° to 1350° C. and a pressure of about 0.4 to 10 torr.

4. The process of claim 1 in which finely divided CaO is included in the admixture of step (a) in an amount sufficient to accelerate the reduction of the chromite in step (c).

5. The process of claim 1 in which the slag composition-adjusting additives of step (d) consist of CaO, MgO, $SiO_2$, $AL_2O_3$ or mixtures thereof.

6. The process of claim 5 in which the types and amount of additives are adjusted to achieve rapid and efficient separation of ferrochromium alloys and gangue materials.

7. The process of claim 6 in which the resulting slag composition consists of about 28 to 30 percent CaO, 28 to 30 percent MgO, 28 to 30 percent $SiO_2$, and 10 to 16 percent $Al_2O_3$.

8. The process of claim 1 in which the temperature in step (e) is about 1550° to 1700° C.

9. The process of claim 1 in which the slag composition-adjusting additives of step (d) are added to the reduced product while the latter is still at a temperature of about 1300° to 1350° C.

* * * * *